US007155887B2

(12) United States Patent
Bates

(10) Patent No.: US 7,155,887 B2
(45) Date of Patent: Jan. 2, 2007

(54) SADDLE CLOTHS

(75) Inventor: Ronald Gordon Bates, Mount Lawley (AU)

(73) Assignee: Hammersmith Nominees Pty. Ltd, Perth (AU)

( * ) Notice: Subject to any disclaimer, the term of this patent is extended or adjusted under 35 U.S.C. 154(b) by 0 days.

(21) Appl. No.: 10/211,996

(22) Filed: Aug. 2, 2002

(65) Prior Publication Data

US 2003/0037518 A1 Feb. 27, 2003

(30) Foreign Application Priority Data

Aug. 3, 2001 (AU) ..... PR6825/01

(51) Int. Cl.
*B68C 1/12* (2006.01)

(52) U.S. Cl. ..... 54/79.3; 54/44.5; 54/66

(58) Field of Classification Search ..... 54/41.1, 54/44.5, 44.6, 65, 66, 79.1, 79.3
See application file for complete search history.

(56) References Cited

U.S. PATENT DOCUMENTS

| | | | | |
|---|---|---|---|---|
| 734,100 | A | 7/1903 | Sena | |
| 3,343,338 | A * | 9/1967 | Stubben | 54/44.6 |
| 4,033,097 | A | 7/1977 | Petit | |
| 4,471,538 | A | 9/1984 | Pomeranz et al. | |
| 4,683,709 | A | 8/1987 | Vasko et al. | |
| 4,695,496 | A | 9/1987 | Lee | |
| 4,745,734 | A | 5/1988 | Brown | |
| 4,840,425 | A | 6/1989 | Noble | |
| 4,974,397 | A | 12/1990 | Ricken | |
| 5,018,341 | A * | 5/1991 | Evertson | 54/66 |
| 5,027,589 | A * | 7/1991 | Gleb et al. | 54/66 |
| 5,179,821 | A | 1/1993 | Hiser | |
| 5,299,412 | A * | 4/1994 | Cudney et al. | 54/66 |
| 5,329,751 | A | 7/1994 | Wadsworth | |
| 5,363,631 | A | 11/1994 | Garrison | |
| 5,383,328 | A | 1/1995 | Brown | |
| 5,517,808 | A | 5/1996 | Schleese | |
| 5,555,710 | A | 9/1996 | Smith | |
| 5,685,133 | A | 11/1997 | Travis | |
| 5,782,070 | A * | 7/1998 | Knight et al. | 54/66 |
| 5,787,692 | A | 8/1998 | Purdy | |
| 5,802,823 | A * | 9/1998 | Woods | 54/66 |
| 6,050,067 | A | 4/2000 | Knight et al. | |
| 6,474,052 | B1 * | 11/2002 | Kempsell et al. | 54/44.6 |
| 6,481,189 | B1 * | 11/2002 | Bates | 54/44.6 |
| 6,588,185 | B1 | 7/2003 | Goblet | |

FOREIGN PATENT DOCUMENTS

| | | |
|---|---|---|
| AU | 23770/92 | 11/1993 |
| AU | 49621/93 | 8/1994 |
| CH | 446 045 | 3/1968 |
| DE | 2 133 034 | 1/1973 |

(Continued)

*Primary Examiner*—Son T. Nguyen
(74) *Attorney, Agent, or Firm*—Knobbe, Martens, Olson & Bear LLP

(57) ABSTRACT

A saddle cloth for equestrian use to be applied to a horse prior to application of the saddle has zones adapted to lie beneath the saddle panels at respective sides of the horse. Each zone includes within a pocket, a separate air bag at least in a forward and a rearward part of the zone such that each air bag serves to apply a relatively even pressure to the back of the horse. Each air bag is substantially flat and is filled within its interior with a resiliently compressible open cell foam and air sealed within the bag is substantially at atmospheric pressure.

7 Claims, 6 Drawing Sheets

FOREIGN PATENT DOCUMENTS

| | | | | |
|---|---|---|---|---|
| DE | 2259376 | A | * | 6/1974 |
| DE | 24 28 852 | | | 1/1976 |
| DE | 41 36 907 | | | 5/1992 |
| DE | 41 00 027 | | | 7/1992 |
| DE | 41 14 433 | | | 11/1992 |
| DE | 94 11 519.2 | | | 11/1994 |
| DE | 199 47 304 | | | 4/2001 |
| DE | 10053529 | A1 | * | 5/2002 |
| EP | 0 060 449 | | | 9/1985 |
| EP | 0 328 376 | | | 10/1991 |
| EP | 0764607 | A1 | * | 3/1997 |
| FR | 2 632 623 | | | 12/1989 |
| FR | 2 667 584 | | | 4/1992 |
| FR | 2670769 | A1 | * | 6/1992 |
| GB | 434459 | | | 9/1935 |
| GB | 1 453 810 | | | 10/1976 |
| GB | 2090512 | A | * | 7/1982 |
| GB | 2 108 362 | | | 5/1983 |
| GB | 2 259 436 | | | 3/1993 |
| GB | 2 279 546 | | | 1/1995 |
| GB | 2 282 742 | | | 4/1995 |
| GB | 2 304 521 | | | 3/1997 |
| GB | 2 308 799 | | | 7/1997 |
| GB | 2 336 092 | | | 10/1999 |
| WO | WO 90/00518 | | * | 1/1990 |
| WO | PCT/US92/04279 | | | 11/1993 |
| WO | PCT/US97/24134 | | | 7/1998 |
| WO | PCT/DK98/00371 | | | 4/1999 |
| WO | WO 02/076877 | A2 | * | 10/2002 |

* cited by examiner

SADDLE CLOTHS

RELATED APPLICATIONS

This application claims the benefit of the Australian application PR6825/01 filed Aug. 3, 2001.

BACKGROUND OF THE INVENTION

1. Field of the Invention

The present invention relates to saddle cloths for use with equestrian saddles.

2. Description of the Prior Art

Typically a saddle cloth is laid over the back of the horse prior to application of the saddle. The saddle cloth serves to protect the saddle from perspiration of the horse and also to reduce chaffing of the saddle against the horse.

A conventional saddle has at its underside panels of a compressible structure intended to spread the weight of the rider over the back of the horse. Conventionally, the panels consist of an envelope into which a packing of wool or comparable synthetic material is inserted by hand. In principle, the packing formed by the wool or other filling is intended to conform to the shape of the horse's back and thereby to spread the load while minimising pressure points on the horse's back. When a saddle is used only on one horse, the panels of the saddle will, over a period of time, compress and set to take on the shape of the particular horse's back. However the extent of possible compression which occurs in the packing is relatively limited and unless the saddle tree is shaped to the exact conformity of the horse, pressure points often arise where too much of the weight of the rider is transferred to the horse's back in specific areas. This results in the skin not receiving sufficient blood flow which reduces the ability of the skin to sweat and if this situation continues for a long period of time it can result in hair loss, sore back, and possible muscle damage to the horse. These problems are compounded when, and as often happens, the saddle is used on more than one horse whereby the compression needed to properly bed the saddle down onto the horse will not arise.

SUMMARY OF THE INVENTION

According to the present invention, there is provided a saddle cloth for equestrian use to be applied to a horse prior to application of the saddle, said saddle cloth having zones adapted to lie at respective sides of the horse at which pressure from the saddle is applied to the horse's back, each said zone having a separate air bag at least in a forward and a rearward part of the zone and each air bag in use serving to apply a relatively even pressure to the back of the horse.

In a preferred embodiment of the invention, each said zone is provided by a pocket on the saddle cloth for receiving the respective air bags.

Advantageously, each air bag is substantially flat and is substantially filled within its interior with a resiliently compressible open cell foam and air sealed within the bag is substantially at atmospheric pressure.

Advantageously, the bags associated with each zone are formed into a single unit by attachment to a lining layer for insertion into the pocket.

Particularly advantageously, the adjacent side walls of adjacent bags in each zone are in abutting engagement to substantially prevent discontinuity of pressure application to the back of the horse in the transition between adjacent bags. Preferably, the sheet material forming each of the adjacent bags forms a seam extending from one of the upper or lower surfaces of the bag beyond the side wall thereof to engage the corresponding upper or lower surface of the adjacent bag beyond the side wall thereof whereby the seam overlaps the abutting side walls.

Further according to the invention, there is provided a saddle cloth for equestrian use to be applied to a horse prior to application of the saddle, said saddle cloth having zones adapted to lie beneath the saddle panels at respective sides of the horse, each said zone including a separate air bag at least in a forward and a rearward part of the zone such that each air bag in use serves to apply a relatively even pressure to the back of the horse, wherein each air bag is substantially flat and is substantially filled within its interior with a resiliently compressible open cell foam and air sealed within the bag is substantially at atmospheric pressure.

BRIEF DESCRIPTION OF THE DRAWINGS

Embodiments of the invention will now be described by way of example only with reference to the accompanying drawings in which.

DESCRIPTION OF THE PREFERRED EMBODIMENTS

Figure 1:
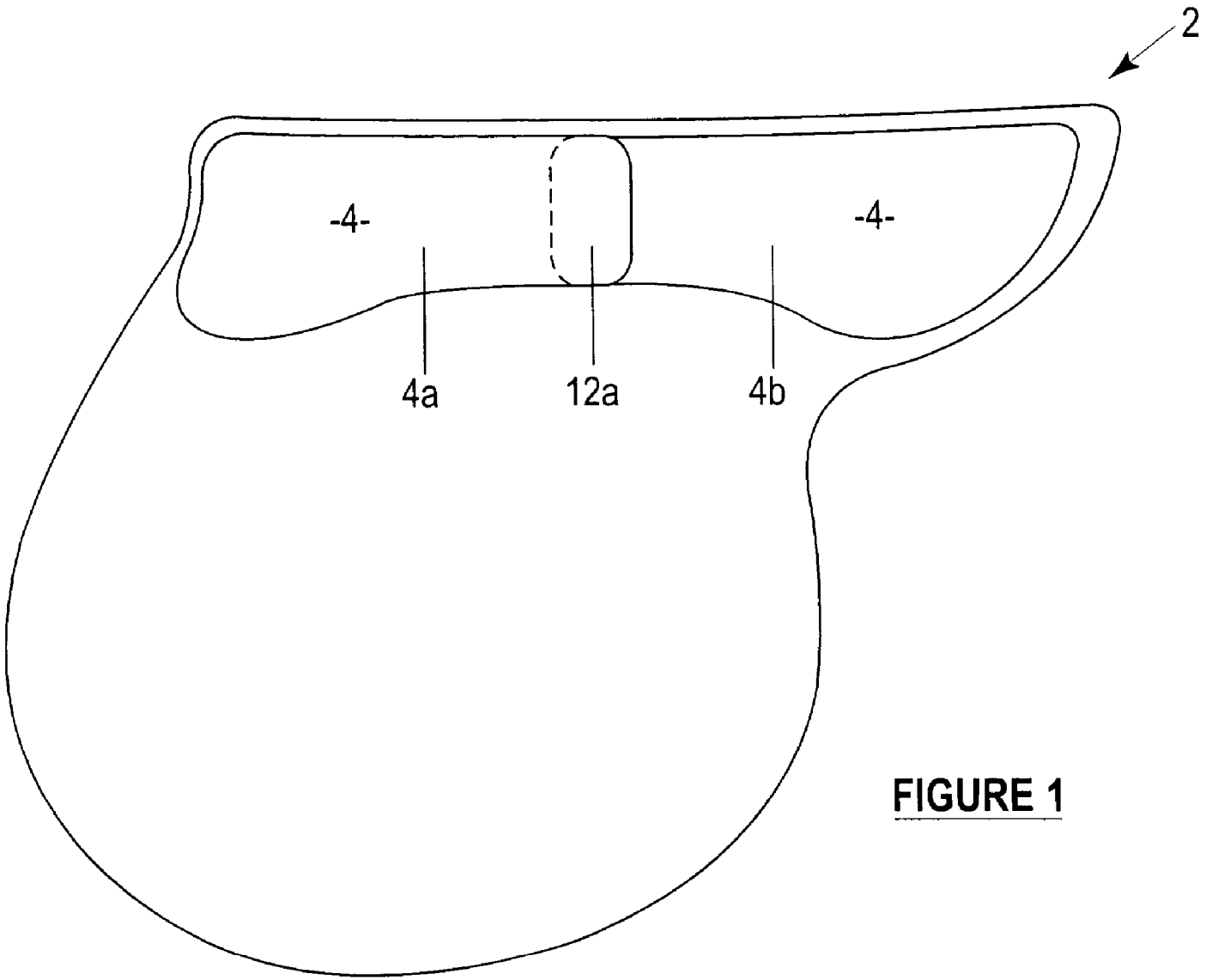
FIG. 1 is a side view showing one half of a saddle cloth in accordance with the invention for an English-style saddle.
Figure 2:
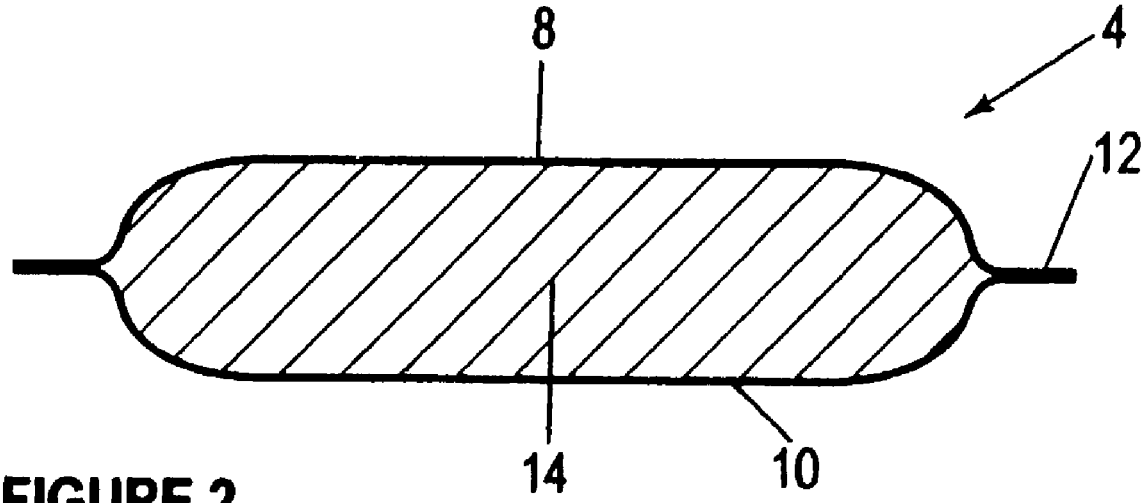
FIG. 2 is a cross section through one form of air bag for incorporation into a pocket in the saddle cloth.
Figure 3:
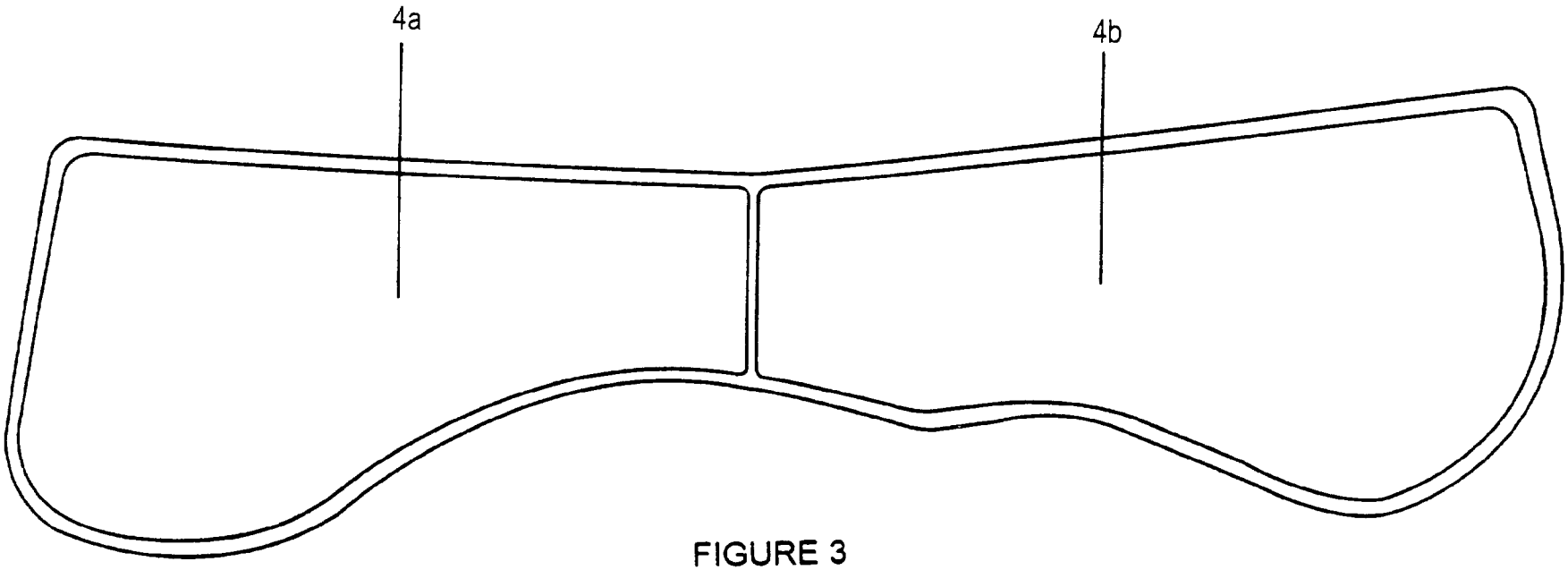
FIG. 3 is a view of an air bag unit consisting of front and rear air bags for insertion into the pocket.

As shown in FIGS. 1 to 3 of the accompanying drawings, a saddle cloth 2 for a conventional "English" style of saddle has in each of two laterally spaced zones which will be contacted by the respective saddle panels a longitudinal pocket which receives an arrangement of air bags 4. The air bags thus lie in the principal zones in which the load from the saddle is applied to the back of the horse.

The air bags 4 are arranged sequentially in a fore-aft direction within the pocket. There may be just two such air bags 4 forming front and rear air bags (designated 4*a*, 4*b*) collectively extending the length of the pocket in the saddle cloth or there may be three or possibly more such air bags consisting of a front, a rear, and one or more intermediate air bags collectively extending the length of the pocket. The respective air bags 4 are sealed and as a result air will not flow between the bags. It is to be noted that if only a single air bag were to be used extending the length of the pocket, substantial air movement would occur from the front to the back of the pocket when the air bag is under pressure during use and this could result in the formation of pressure points. Although with the arrangement now proposed air movement will occur within each individual bag when under load, the extent of air movement is inherently restricted by the length of the bag.

The pocket for containing the air bags can readily be stitched onto the surface of the saddle cloth and have a closure formed by, for example, a hook and loop-type fastening such as that sold under the trade mark VELCRO.

With reference to FIG. 2, each air bag 4 is formed by upper and lower sheets 8, 10 of impervious material such as PVC sealed together around the periphery 12 with each bag having a filling 14 consisting of a layer of an open cell resiliently compressible foam. The air bags 4 are not inflated with air at above atmospheric pressure but, rather, contain air at atmospheric pressure which is sealed within the bag during manufacture, with the open cell foam filling 14 occupying substantially the entirety of the interior of the bag. The resulting air bag is substantially flat and of substantially even thickness throughout.

The two or more air bags 4 are fitted into the pocket separately or, as is preferred, the two or more bags 4 are formed into an air bag unit by attaching a layer of flexible lining material 6 (see FIG. 4) to the upper surface of the air bags 4, for example, by gluing. The lining 6 may consist of the same material as that used for the saddle cloth. FIG. 3 shows an air bag unit consisting of front and rear air bags 4*a*, 4*b*.

The effect of the air bag arrangement is that, in use, air will move within each separate bag and an even pressure will be applied over the entire surface of each air bag at the front or back of the saddle thereby eliminating individual pressure points on the back of the horse, in contrast to conventional saddle arrangements where significant pressure variation on the horse's back can arise within a relatively small area. The application of the even pressure over the surface of the bag is expected to substantially remove possibility for muscle damage and it is expected that this will result in a much freer and more comfortable movement of the horse in use.

It will be understood that although a number of different plastics materials will have substantial impermeability to passage of air and will form suitable materials for the air bags, absolute impermeability might not always be achieved with the result that minor amounts of air might displace through the bag wall when the bag is under heavy loading during prolonged use resulting in minor deflation which does not, however, adversely affect the performance of the bag, but under normal usage this should not occur. However should minor deflation occur under the circumstances discussed above, when the saddle cloth is removed from the horse and the air bag is no longer under load, it has been determined that the expansion of the open cell foam filling within the bag from its previously compressed state does, over a period of time (such as several weeks), cause air to be drawn back into the interior of the bag to establish pressure equilibrium across the wall of the bag. However it is envisaged that if air loss through the bag wall during use does present a problem, laminates can be used which will totally eliminate air loss although these laminates can be relatively expensive and will therefore lead to increased costs.

Figure 4:
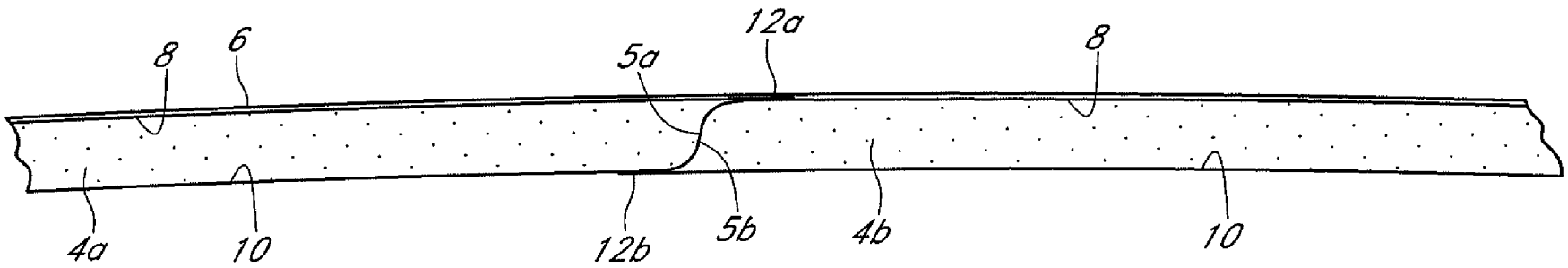
FIG. 4 is a fragmentary cross section showing modified forms of air bag in abutting engagement to provide a substantially seamless transition between adjacent air bags.

Although the adjacent air bags associated with each pocket may be configured as described with reference to FIGS. 2 and 3, it has been determined that it is particularly advantageous for the upper and lower sheets 8, 10 forming each bag to be sealed in a sealing zone lying substantially in the plane of one of the two sheets rather than lying intermediate the planes of the two sheets as shown in FIG. 2. Accordingly, and as shown in FIG. 4, the seals of the adjacent air bags 4*a*, 4*b* associated with each pocket are arranged so that the seal 12*a* of one air bag (as shown, the bag 4*a*) is arranged in the plane of the upper sheet 8 of that bag and the seal 12*b* of the adjacent air bag (as shown, the bag 4*b*) is in the plane of the lower sheet 10 of that bag. With this configuration, the side edges 5*a*, 5*b* of the main bodies of the two adjacent air bags can be mounted in close proximity with the seal 12*a* of the first air bag forming an upper flap which extends over and is adhered to the upper surface of the second air bag and the seal 12*b* of the second air bag extends beneath and is adhered to the lower surface of the first air bag. With this configuration, the adjacent side edges 5*a*, 5*b* of the bodies of the two air bags will tightly abut in the manner shown in FIG. 4 to provide a very even and "seamless" loading transition between the two air bags. It is this configuration which is also illustrated in FIG. 1. In a minor modification to further improve the abutting joint between the adjacent side edges of adjacent bags, the foam layer adjacent the joint is formed with a chamfer or skive, with the two chamfers being oppositely directed so that one faces upwardly and the other downwardly to ensure tight abutment of the adjacent sides of the two bags along an inclined plane thus forming, effectively, a skive joint between the two bags, with the skive joint being enclosed from above and below by upper and lower flaps formed from the abutting layers of the two sheets forming each bag in the zone of the seal between the two sheets. The seal itself may be at the extreme outer edge of those flaps. The modified structure just described further improves the "seamless" feel of the transition between adjacent bags.

FIG. 4 shows an alternative form of saddle cloth for an English-style saddle differing from that of FIG. 1 principally in the overall shape of the cloth itself with commensurate changes in the shaping of the two air bags.

Figure 5:
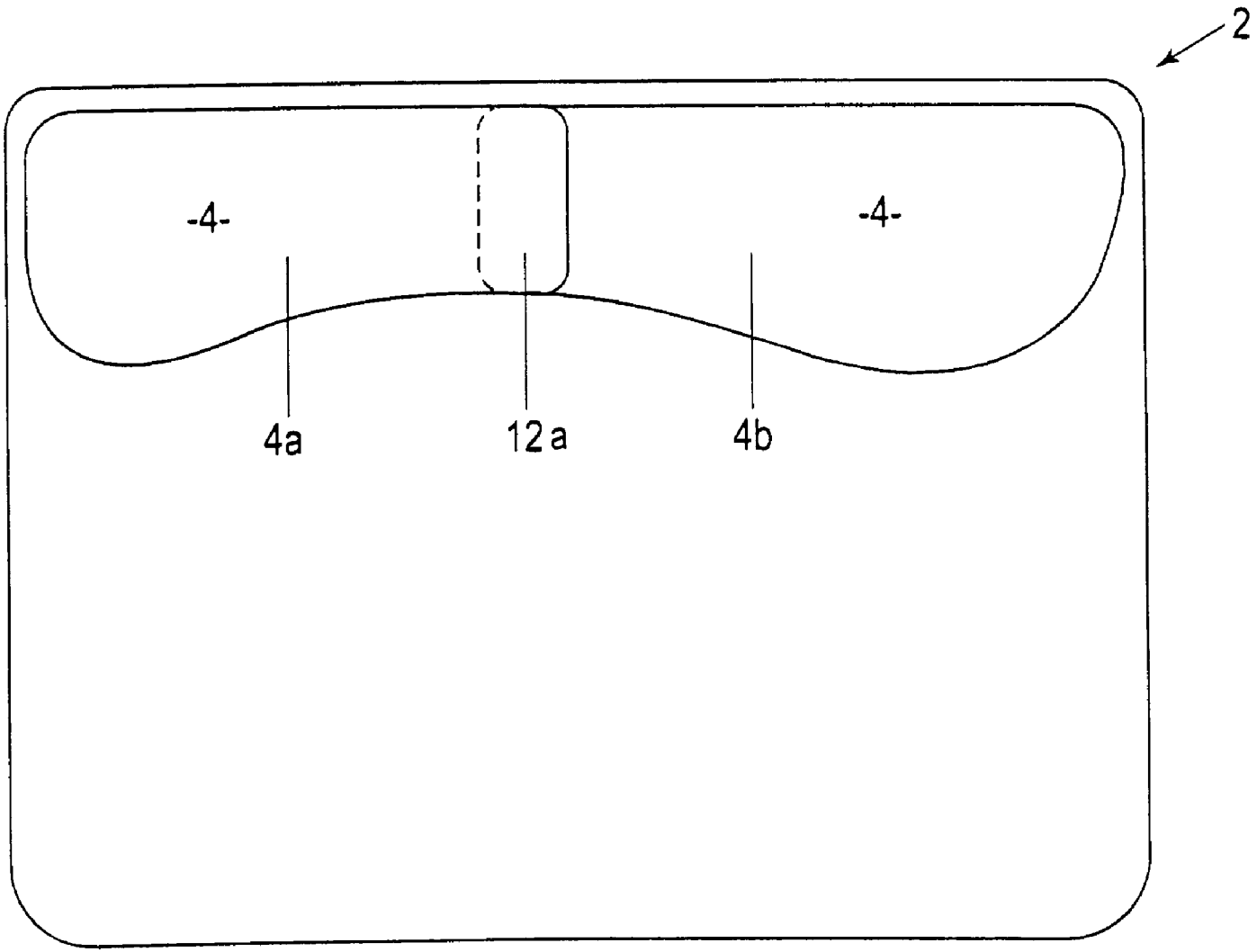
FIG. 5 is a view similar to FIG. 1, but showing a different shaped saddle cloth for an English-style saddle.
Figure 6:
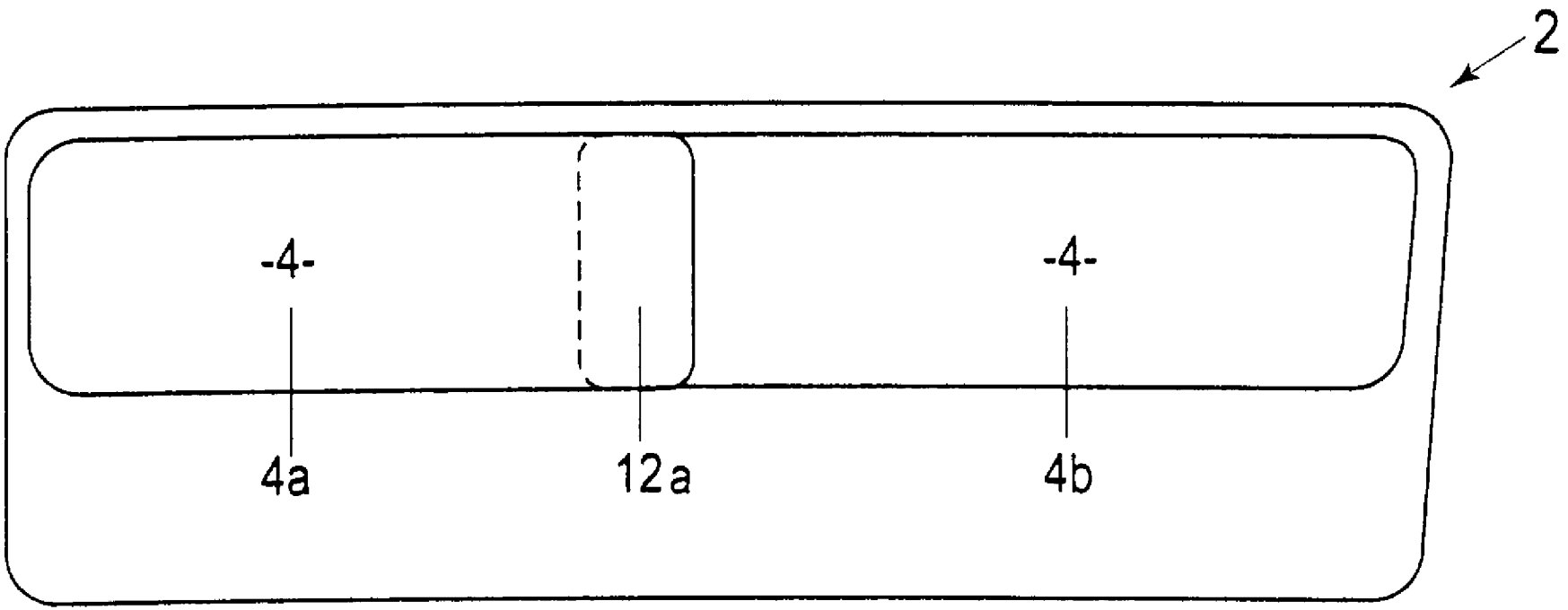
FIG. 6 is a view similar to FIG. 1 and showing a saddle cloth for a Western-style saddle.

There is shown in FIG. 5 a saddle cloth for a conventional "Western" saddle. The construction is essentially the same as that for the English style saddle previously described except that the saddle cloth is somewhat differently shaped due to differences in shaping between the two styles of saddle and in particular the respective sets of air bags are shaped differently to correspond to the typical zones of loading applied to the back of the horse and which is consequent on the loading applied to the respective panels by the associated tree bar present in Western saddles. Apart from this difference in shape, the construction and effect of the air bags is as previously described.

The embodiments have been described by way of example only and modifications are possible within the scope of the invention.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

The invention claimed is:

1. A saddle cloth for equestrian use to be applied to a horse prior to application of a saddle, said saddle cloth having side zones adapted to lie at respective sides of the horse at which pressure from the saddle is applied to horse's back, each side zone having at least two separate sealed abutting air bags, at least one of each located in forward and rearward parts of the side zones in use serving to apply contiguous relatively even pressure to the back of the horse and wherein each air bag is substantially flat and has an outer liner that is permanently sealed at manufacture so as to inhibit the entry of air into the interior of the bag and is filled with compressible open cell foam and wherein air sealed within the bag is substantially maintained at atmospheric pressure such that substantially even pressure is applied over the entire surface of each side zone to thereby reduce individual pressure points on the back of the horse when the saddle cloth is interposed between a saddle and the back of the horse wherein sheet material forming each of the abutting bags forms a seam extending from one of upper or lower surfaces of one bag beyond the adjoining side wall thereof to engage the corresponding upper or lower surface of the abutting bag beyond the adjoining side wall thereof whereby the seam overlaps the adjoining side walls.

2. A saddle cloth according to claim 1, wherein each said zone is provided by a pocket on the saddle cloth for receiving the respective air bags.

3. A saddle cloth according to claim 2, wherein the pocket is attached to a surface of the saddle cloth and includes a resealable closure for closing the pocket to retain the air bags therein.

4. A saddle cloth according to claim 2, wherein the bags associated with each zone are formed into single units by attachment to a lining layer for insertion into the pocket.

5. A saddle cloth according to claim 1, wherein adjacent side walls of abutting bags in each zone are in adjoining engagement to substantially prevent discontinuity of pressure application to the back of the horse in the transition between abutting bags.

6. A saddle cloth for equestrian use to be applied to a horse prior to application of a saddle, said saddle cloth having side zones formed of pockets adapted to lie beneath saddle panels at respective sides of the horse, each side zone including two or more sealed adjacent air bags positioned within the pockets at least one of each located in forward and rearward parts of the zone such that side in use a relatively even pressure is applied to the back of the horse contiguously across each side zone wherein each air bag is substantially flat and is substantially filled within its interior with a resiliently compressible open cell foam and is permanently sealed at manufacture such that air sealed within the bag is substantially at atmospheric pressure and the bags in each of the forward and rear parts of each zone are formed of an upper sheet and a lower sheet that are attached together to define the air bag wherein the upper sheet and the lower sheet further define a flap and wherein the bags in each of the zones are positioned abutting each other such that the flaps on each of the bags are positioned on the upper or lower surfaces of the adjacent bag so as to provide a substantially seamless loading transition between the two bags and wherein the pockets are dimensioned to retain the flaps in position on the adjacent bag.

7. A saddle cloth according to claim 6, wherein each said side zone is defined by a pocket into which the air bags are inserted, the pocket including a resealable closure.

* * * * *